US010391536B1

(12) United States Patent
Hubbard

(10) Patent No.: US 10,391,536 B1
(45) Date of Patent: Aug. 27, 2019

(54) TOOL KIT FOR BENDING A METAL TRAY

(71) Applicant: Shawn Hubbard, Lake Jackson, TX (US)

(72) Inventor: Shawn Hubbard, Lake Jackson, TX (US)

( * ) Notice: Subject to any disclaimer, the term of this patent is extended or adjusted under 35 U.S.C. 154(b) by 0 days.

(21) Appl. No.: 15/086,557

(22) Filed: Mar. 31, 2016

(51) Int. Cl.

| | |
|---|---|
| ***B21D 3/10*** | (2006.01) |
| ***B21D 11/20*** | (2006.01) |
| ***B21D 39/02*** | (2006.01) |
| ***B21D 1/12*** | (2006.01) |
| ***B21D 1/06*** | (2006.01) |

(52) U.S. Cl.
CPC ..... *B21D 11/20* (2013.01); *B21D 1/06* (2013.01); *B21D 1/12* (2013.01); *B21D 39/025* (2013.01)

(58) Field of Classification Search
CPC ..... B21D 1/06; B21D 1/12; B21D 39/025; B21D 11/20
USPC ..... 72/479
See application file for complete search history.

(56) References Cited

U.S. PATENT DOCUMENTS 1,326,907 A * 1/1920 Bond ..... B21D 1/08 72/458
1,616,653 A * 2/1927 Lee ..... B21D 1/08 72/458
1,879,583 A * 9/1932 Stowell ..... B21D 7/063 72/458
3,087,242 A 4/1963 Bohn
4,236,427 A * 12/1980 Becnel ..... B60P 7/0853 254/131
4,841,821 A * 6/1989 Cooper ..... B25B 27/205 29/247
5,611,237 A * 3/1997 Harper ..... B21D 19/02 72/458
5,768,790 A * 6/1998 Norman ..... B21D 7/063 33/334
5,934,138 A * 8/1999 Semien ..... B21D 7/063 72/458
5,937,695 A * 8/1999 Patterson ..... B21D 19/08 72/458
6,264,771 B1 * 7/2001 Bornschlegl ..... B24C 1/10 148/697
7,690,239 B2 * 4/2010 Griffis ..... B21D 1/06 29/243.5
8,424,361 B1 * 4/2013 Evans ..... B21D 39/025 72/458

* cited by examiner

*Primary Examiner* — David B Jones

(57) ABSTRACT

A tool kit for bending a metal tray including a middle bending tool, a right bending tool, and a left bending tool. The middle bending tool further includes a middle lower handle and a C-shaped middle top clamping member. The middle lower handle is perpendicularly extended from the middle bottom plate of the middle top clamping member. The right bending tool further includes a right lower handle and a C-shaped right top clamping member. The right lower handle is rightwardly extended at a forty-five degree angle from the right bottom plate of the right top clamping member. The left bending tool further includes a left lower handle and a C-shaped left top clamping member. The left lower handle is leftwardly extended at a forty-five degree angle from the left bottom plate of the left top clamping member.

5 Claims, 4 Drawing Sheets

TOOL KIT FOR BENDING A METAL TRAY

BACKGROUND OF THE INVENTION

Various types of tool kits are known in the prior art. However, what has been needed is a tool kit for bending a metal tray including a middle bending tool, a right bending tool, and a left bending tool. What has been further needed is for the middle bending tool to include a middle lower handle and a C-shaped middle top clamping member, with the middle lower handle perpendicularly extended from the middle bottom plate of the middle top clamping member. The right bending tool further includes a right lower handle and a C-shaped right top clamping member, with the right lower handle rightwardly extended at a forty-five degree angle from the right bottom plate of the right top clamping member. Lastly, what has been needed is for the left bending tool to further include a left lower handle and a C-shaped left top clamping member, with the left lower handle leftwardly extended at a forty-five degree angle from the left bottom plate of the left top clamping member. Each of the right top clamping member of the right bending tool, the middle top clamping member of the middle bending tool, and the left top clamping member of the left bending tool is configured to bend the metal tray to a shape desired by a user while the user firmly grasps and manipulates each of the right lower handle, the middle lower handle, and the left lower handle. The tool kit for bending a metal tray is thus specifically structured to provide a user with an easy and effective way in which to bend a metal tray.

FIELD OF THE INVENTION

The present invention relates to tool kits, and more particularly, to a tool kit for bending a metal tray.

SUMMARY OF THE INVENTION

The general purpose of the present tool kit for bending a metal tray, described subsequently in greater detail, is to provide a tool kit for bending a metal tray which has many novel features that result in a tool kit for bending a metal tray which is not anticipated, rendered obvious, suggested, or even implied by prior art, either alone or in combination thereof.

To accomplish this, the present tool kit for bending a metal tray includes a middle bending tool, a right bending tool, and a left bending tool. The middle bending tool further includes a solid cylindrical middle lower handle and a C-shaped middle top clamping member. The middle lower handle has a bottom end, a top end, and a middle gripping member disposed over the bottom end. The middle top clamping member has a rectangular middle top plate, a rectangular middle bottom plate, a middle rear portion disposed between the middle top plate and the middle bottom plate, and a middle opening disposed between the middle top plate and the middle bottom plate. The middle bottom plate is substantially medially welded to the top end of the middle lower handle. The middle lower handle is perpendicularly extended from the middle bottom plate of the middle top clamping member.

The right bending tool further includes a solid cylindrical right lower handle and a C-shaped right top clamping member. The right lower handle has a lower end, an upper end, and a right gripping member disposed over the lower end. The right top clamping member has a square-shaped right top plate, a square-shaped right bottom plate, a middle rear section disposed between the right top plate and the right bottom plate, and a right opening disposed between the right top plate and the right bottom plate. The right bottom plate is substantially medially welded to the upper end of the right lower handle. The right lower handle is rightwardly extended at a forty-five degree angle from the right bottom plate of the right top clamping member.

The left bending tool further includes a solid cylindrical left lower handle and a C-shaped left top clamping member. The left lower handle has a bottom side, a top side, and a left gripping member disposed over the bottom side. The left top clamping member has a square-shaped left top plate, a square-shaped left bottom plate, a left rear section disposed between the left top plate and the left bottom plate, and a left opening disposed between the left top plate and the left bottom plate. The left bottom plate is substantially medially welded to the top side of the left lower handle. The left lower handle is leftwardly extended at a forty-five degree angle from the left bottom plate of the left top clamping member.

Each of the right opening of the right top clamping member of the right bending tool, the middle opening of the middle top clamping member of the middle bending tool, and the left opening of the left top clamping member of the left bending tool removably and slidably engages an edge of a metal tray. Each of the right top clamping member of the right bending tool, the middle top clamping member of the middle bending tool, and the left top clamping member of the left bending tool is configured to bend the metal tray to a shape desired by a user while the user firmly grasps and manipulates each of the right lower handle, the middle lower handle, and the left lower handle.

The preferred dimensions for the instant tool kit include each of the right lower handle, the middle lower handle, and the left lower handle having an optional length of 9 inches 9.5 inches, and 9 inches, respectively. An optional length and a width of the square-shaped right top clamping member and the left top clamping member is 2 inches. An optional length of the middle top clamping member is 2 inches, and an optional width of the middle top clamping member is 1.5 inches. Lastly, an optional preferred height of each of the right opening of the right top clamping member of the right bending tool, the middle opening of the middle top clamping member of the middle bending tool, and the left opening of the left top clamping member of the left bending tool is 0.25 inches. These specific dimensional configurations further assist the tool kit in more easily bending a metal tray.

Thus has been broadly outlined the more important features of the present tool kit for bending a metal tray so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
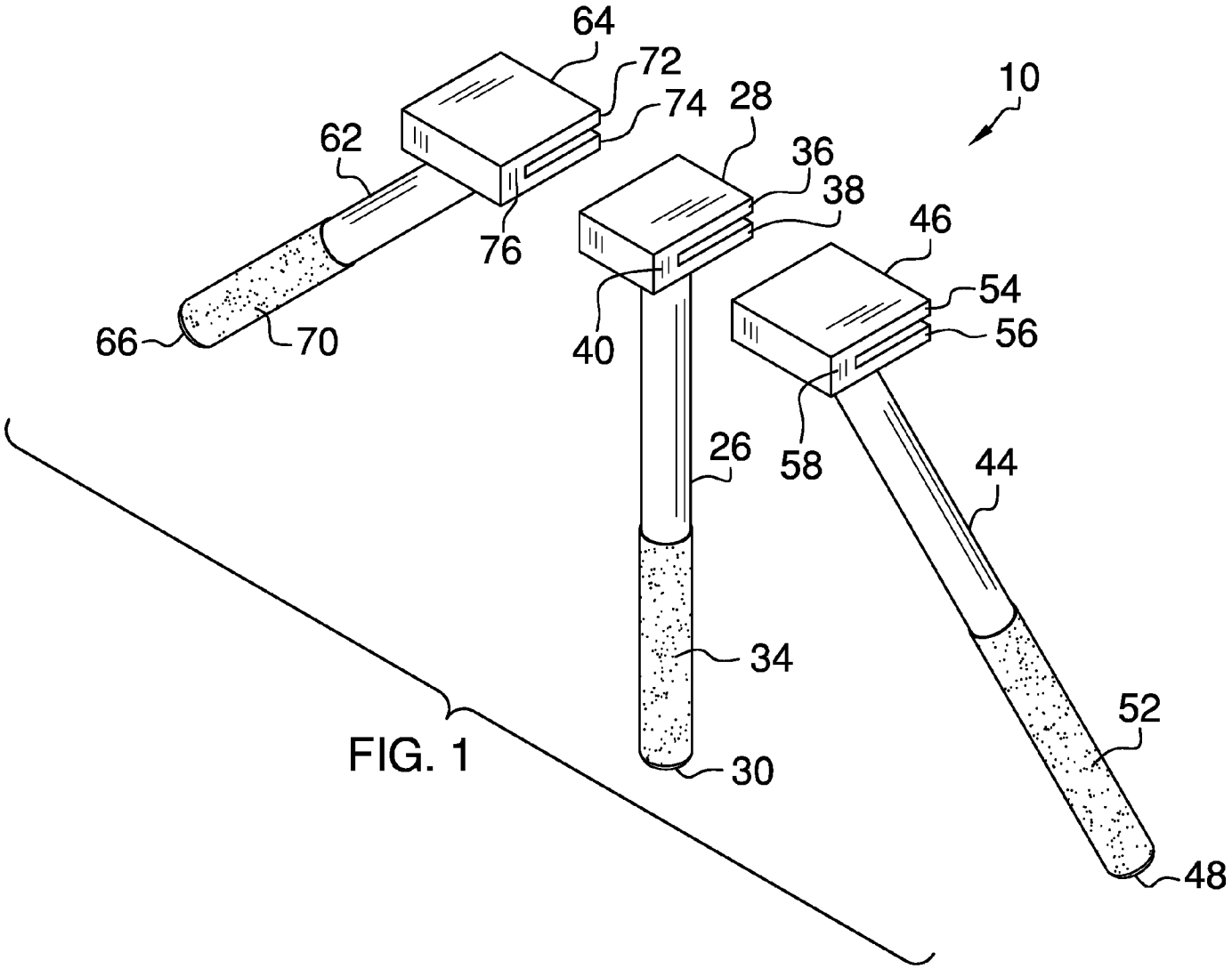
FIG. 1 is a front isometric view.
Figure 2:
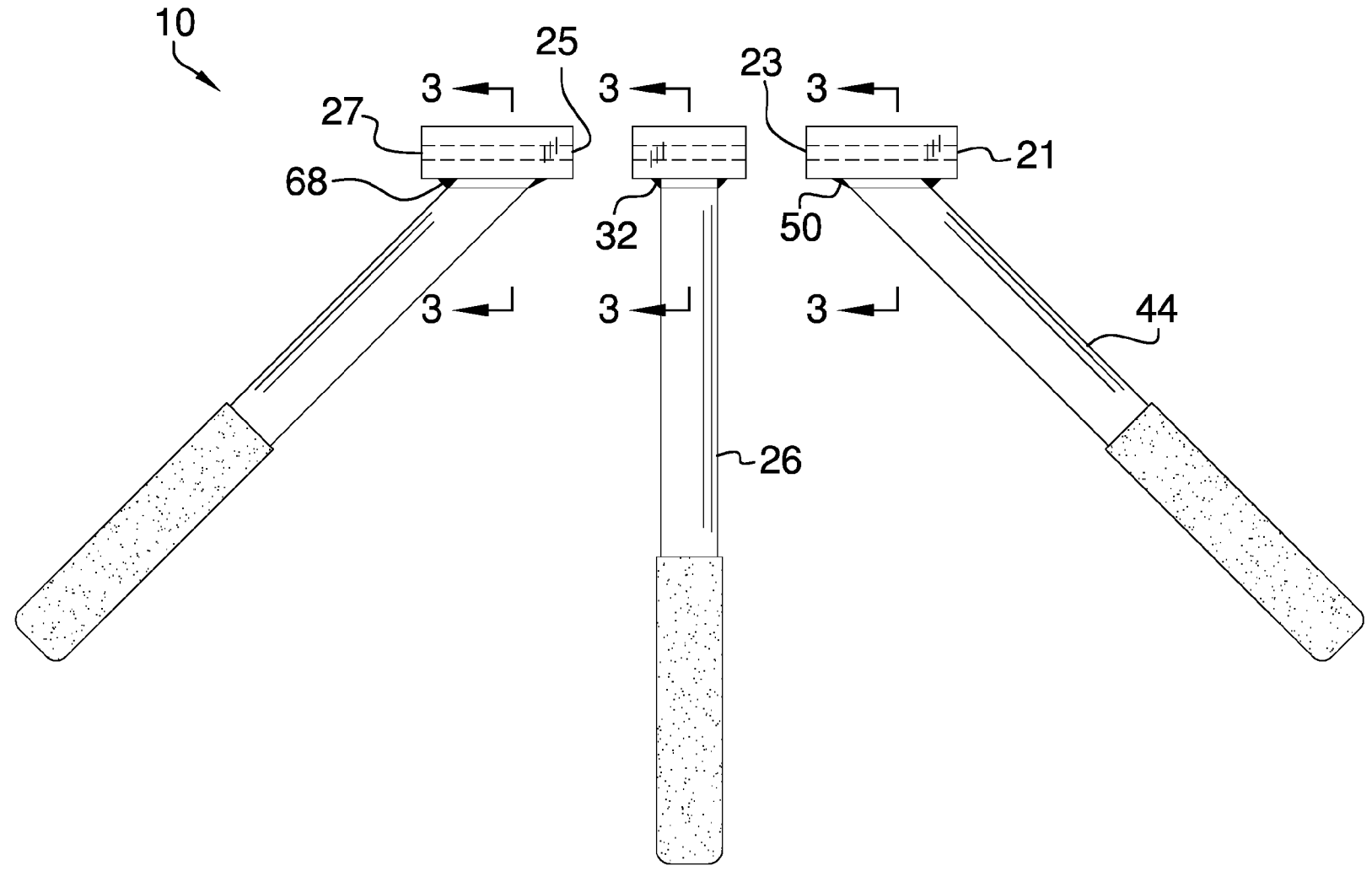
FIG. 2 is a front elevation view.
Figure 3:
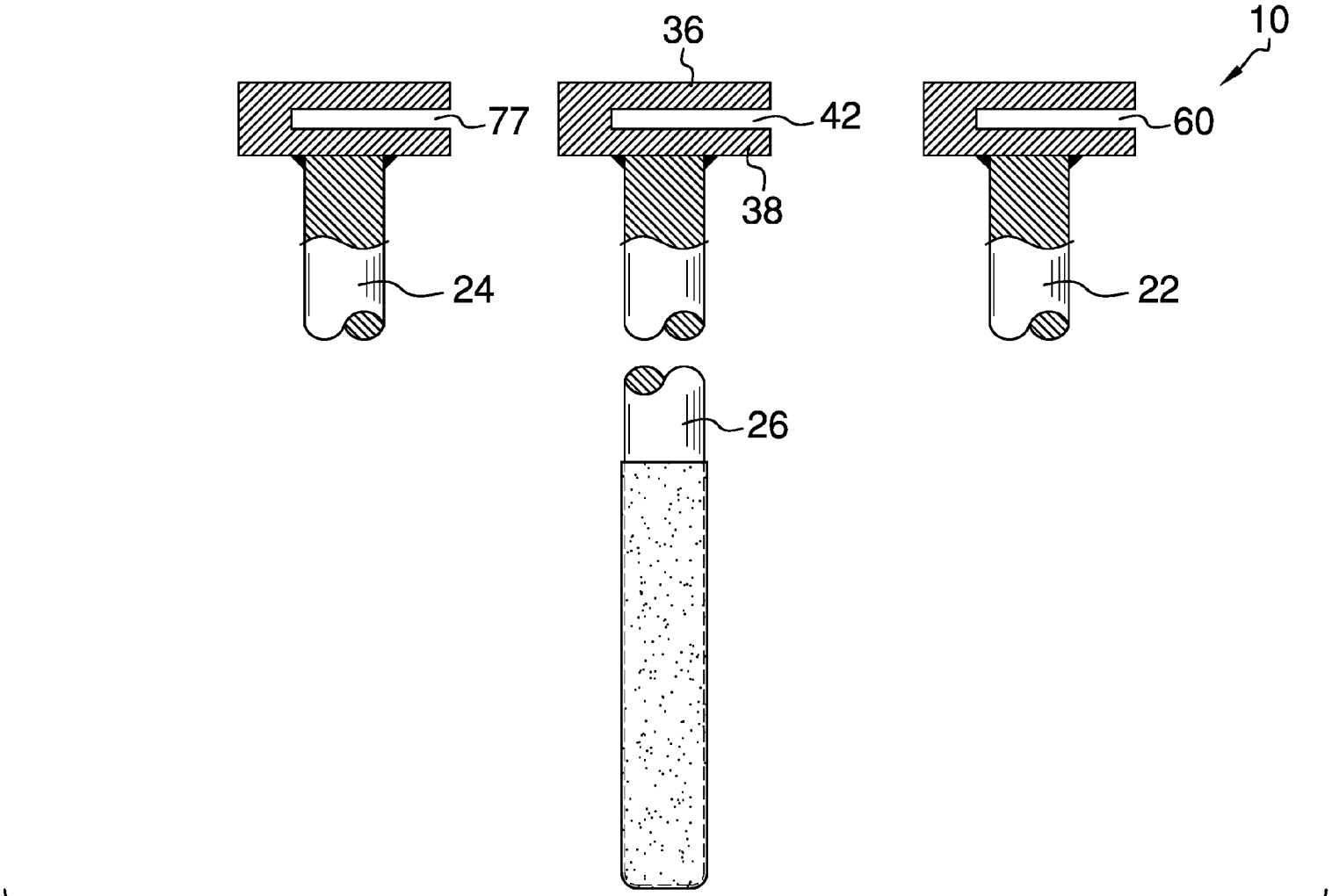
FIG. 3 is a cross-sectional view taken along line 3-3 of FIG. 2.
Figure 4:
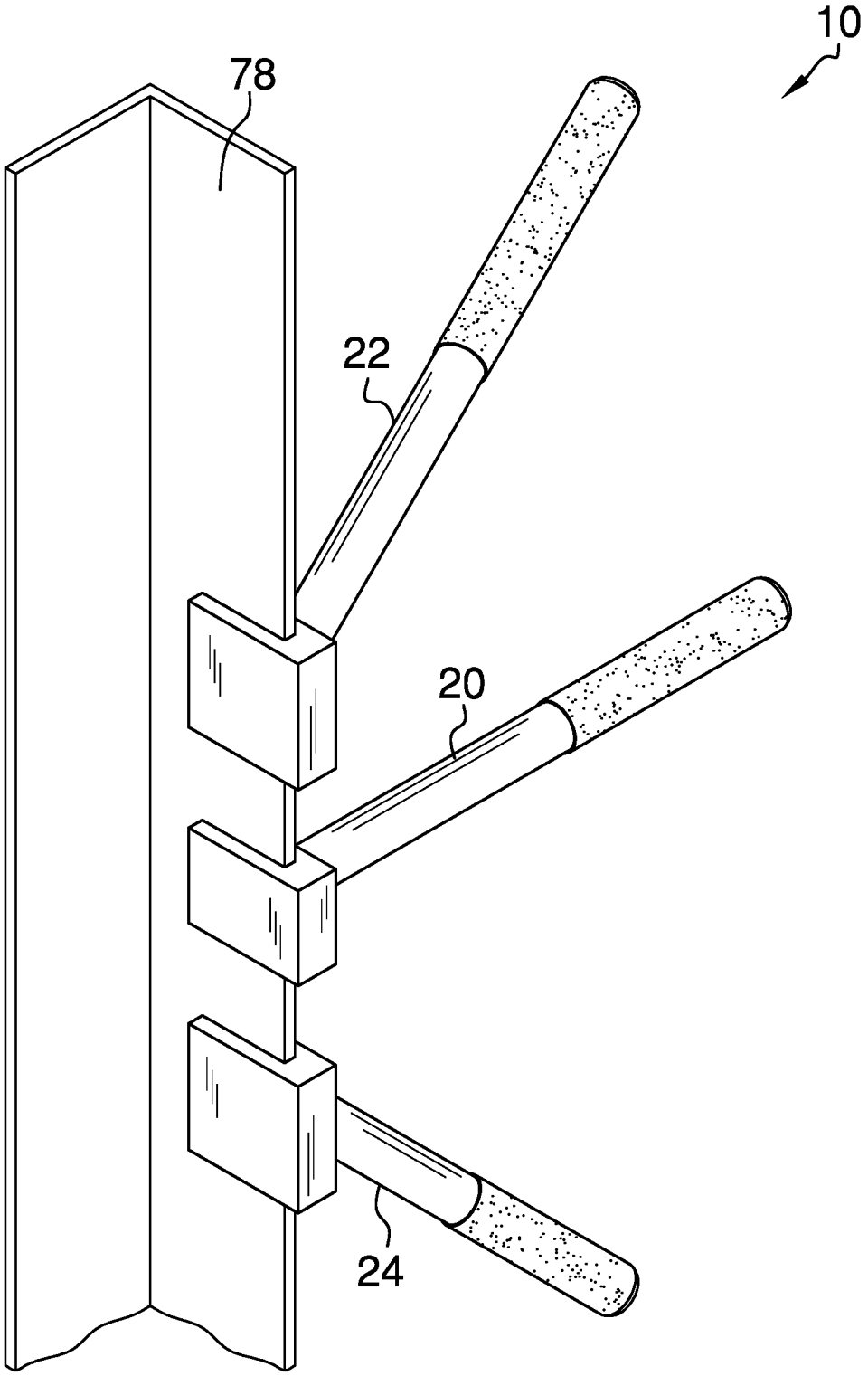
FIG. 4 is an in use view.

With reference now to the drawings, and in particular FIGS. 1 through 4 thereof, an example of the instant tool kit for bending a metal tray employing the principles and concepts of the present tool kit for bending a metal tray and generally designated by the reference number 10 will be described.

Referring to FIGS. 1 through 4 the present tool kit for bending a metal tray 10 is illustrated. The tool kit for bending a metal tray 10 includes a middle bending tool 20, a right bending tool 22, and a left bending tool 24. The middle bending tool 20 further includes a solid cylindrical middle lower handle 26 and a C-shaped middle top clamping member 28. The middle lower handle 26 has a bottom end 30, a top end 32, and a middle gripping member 34 disposed over the bottom end 30. The middle top clamping member 28 has a rectangular middle top plate 36, a rectangular middle bottom plate 38, a middle rear portion 40 disposed between the middle top plate 36 and the middle bottom plate 38, and a middle opening 42 disposed between the middle top plate 36 and the middle bottom plate 38. The middle bottom plate 38 is substantially medially welded to the top end 32 of the middle lower handle 26. The middle lower handle 26 is perpendicularly extended from the middle bottom plate 38 of the middle top clamping member 28.

The right bending tool 22 further includes a solid cylindrical right lower handle 44 and a C-shaped right top clamping member 46. The right lower handle 44 has a lower end 48, an upper end 50, and a right gripping member 52 disposed over the lower end 48. The right top clamping member 46 has a right surface 21, a left surface 23, a square-shaped right top plate 54, a square-shaped right bottom plate 56, a middle rear section 58 disposed between the right top plate 54 and the right bottom plate 56, and a right opening 60 disposed between the right top plate 54 and the right bottom plate 56. The right bottom plate 56 is substantially medially welded to the upper end 50 of the right lower handle 44. The right lower handle 44 is extended at a forty-five degree angle from the right bottom plate 56 of the right top clamping member 46 toward the right surface 21.

The left bending tool 24 further includes a solid cylindrical left lower handle 62 and a C-shaped left top clamping member 64. The left lower handle 62 has a bottom side 66, a top side 68, and a left gripping member 70 disposed over the bottom side 66. The left top clamping member 64 has a right area 25, a left area 27, a square-shaped left top plate 72, a square-shaped left bottom plate 74, a left rear section 76 disposed between the left top plate 72 and the left bottom plate 74, and a left opening 77 disposed between the left top plate 72 and the left bottom plate 74. The left bottom plate 74 is substantially medially welded to the top side 68 of the left lower handle 62. The left lower handle 62 is leftwardly extended at a forty-five degree angle from the left bottom plate 74 of the left top clamping member 64 toward the left area 27.

Each of the right opening 60 of the right top clamping member 46 of the right bending tool 22, the middle opening 42 of the middle top clamping member 28 of the middle bending tool 20, and the left opening 77 of the left top clamping member 64 of the left bending tool 24 removably and slidably engages an edge of a metal tray 78. Each of the right top clamping member 46 of the right bending tool 22, the middle top clamping member 28 of the middle bending tool 20, and the left top clamping member 64 of the left bending tool 24 is configured to bend the metal tray 78.

What is claimed is:

1. A tool kit for bending a metal tray comprising:

a middle bending tool further comprising:

a solid cylindrical middle lower handle having a bottom end, a top end, and a middle gripping member disposed over the bottom end; and a C-shaped middle top clamping member having a rectangular middle top plate, a rectangular middle bottom plate, a middle rear portion disposed between the middle top plate and the middle bottom plate, and a middle opening disposed between the middle top plate and the middle bottom plate, wherein the middle bottom plate is substantially medially welded to the top end of the middle lower handle;

wherein the middle lower handle is perpendicularly extended from the middle bottom plate of the middle top clamping member;

a right bending tool further comprising:

a solid cylindrical right lower handle having a lower end, an upper end, and a right gripping member disposed over the lower end; and a C-shaped right top clamping member having a right surface, a left surface, a square-shaped right top plate, a square-shaped right bottom plate, a middle rear section disposed between the right top plate and the right bottom plate, and a right opening disposed between the right top plate and the right bottom plate, wherein the right bottom plate is substantially medially welded to the upper end of the right lower handle;

wherein the right lower handle is extended at a forty-five degree angle from the right bottom plate of the right top clamping member toward the right surface;

a left bending tool further comprising:

a solid cylindrical left lower handle having a bottom side, a top side, and a left gripping member disposed over the bottom side; and a C-shaped left top clamping member having a right area, a left area, a square-shaped left top plate, a square-shaped left bottom plate, a left rear section disposed between the left top plate and the left bottom plate, and a left opening disposed between the left top plate and the left bottom plate, wherein the left bottom plate is substantially medially welded to the top side of the left lower handle;

wherein the left lower handle is extended at a forty-five degree angle from the left bottom plate of the left top clamping member toward the left area;

wherein each of the right opening of the right top clamping member of the right bending tool, the middle opening of the middle top clamping member of the middle bending tool, and the left opening of the left top clamping member of the left bending tool removably and slidably engages an edge of a metal tray;

wherein each of the right top clamping member of the right bending tool, the middle top clamping member of the middle bending tool, and the left top clamping member of the left bending tool is configured to bend the metal tray to a shape desired by a user.

2. The tool kit for bending a metal tray of claim 1 wherein a length of each of the right lower handle, the middle lower handle, and the left lower handle is 9 inches 9.5 inches, and 9 inches, respectively.

3. The tool kit for bending a metal tray of claim 2 wherein each of a length and a width of the right top clamping member and the left top clamping member is 2 inches.

4. The tool kit for bending a metal tray of claim 3 wherein a length of the middle top clamping member is 2 inches, and a width of the middle top clamping member is 1.5 inches.

5. The tool kit for bending a metal tray of claim 4 wherein a height of each of the right opening of the right top clamping member of the right bending tool, the middle opening of the middle top clamping member of the middle bending tool, and the left opening of the left top clamping member of the left bending tool is 0.25 inches.

* * * * *